United States Patent [19]

Michalik

[11] Patent Number: 5,056,694

[45] Date of Patent: Oct. 15, 1991

[54] CLOTHES HANGER PAD CONSTRUCTION

[76] Inventor: Albert S. Michalik, 15326 S. Diekman Ct., Dolton, Ill. 60419

[21] Appl. No.: 555,189

[22] Filed: Jul. 20, 1990

[51] Int. Cl.[5] ..... A47G 25/20; A47G 25/60

[52] U.S. Cl. ..... 223/98; 223/86; D6/328

[58] Field of Search ..... 223/98, 88, 85, 86, 223/92; D6/315, 318, 328

[56] References Cited

U.S. PATENT DOCUMENTS

| | | | |
|---|---|---|---|
| 2,099,308 | 11/1937 | McAllister | 223/98 |
| 2,147,590 | 2/1939 | Adkins | 223/98 |
| 2,591,163 | 4/1952 | Kivett | 223/98 |
| 2,662,775 | 12/1952 | Sasaki | 223/98 |
| 2,828,899 | 4/1958 | Zuckerman | 223/98 |
| 3,212,687 | 9/1965 | Bradley | 223/98 |
| 3,347,428 | 9/1967 | Gauthier | 223/98 |
| 3,602,408 | 8/1971 | Gaydos | 223/98 |
| 4,632,287 | 12/1986 | Bevelander | 223/98 |
| 4,658,997 | 4/1987 | Nash | 223/98 |

FOREIGN PATENT DOCUMENTS

| | | | |
|---|---|---|---|
| 610470 | 12/1957 | Canada | 223/88 |

*Primary Examiner*—Werner H. Schroeder
*Assistant Examiner*—Bibhu Mohanty
*Attorney, Agent, or Firm*—Leon Gilden

[57] ABSTRACT

A pad construction for use and securement to each end of a coat hanger, wherein the pad construction includes an elongate flexible deformable pad positionable to accommodate clothing of various configurations, wherein the pad includes band construction to secure the pad to the clothes hanger member. The pad construction may be further formed with longitudinally parallel deformable rods to maintain a desired deformation of the pad relative to the coat hanger construction. Further, the pad is optionally formed with an elongate pocket directed through an upper surface of the pad to receive and secure a sponge-like absorbent member therewithin, wherein the sponge-like member is saturated with various fluids, such as perfume, anti-germicidal fluids, and insect control fluids such as moth repellants and the like.

4 Claims, 5 Drawing Sheets

PRIOR ART

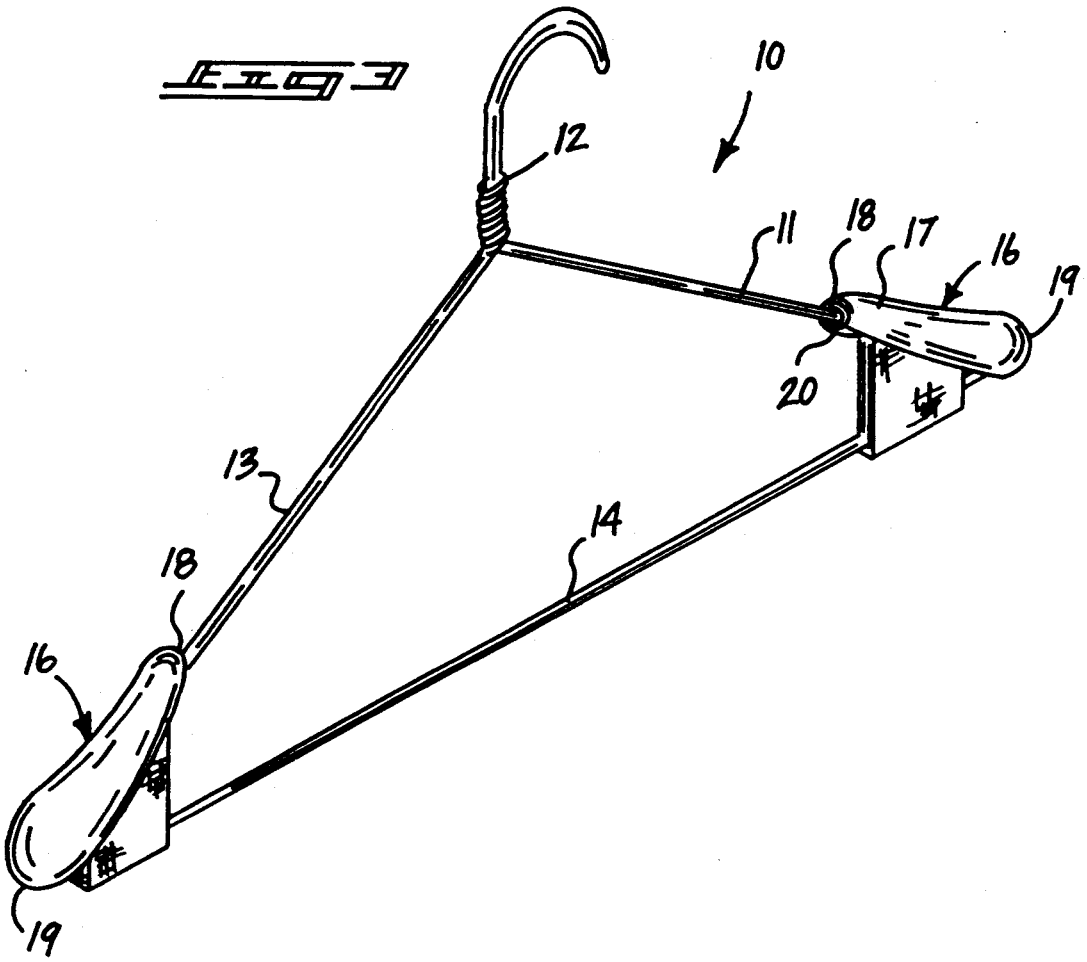
10
12
11
18
17
16
19
20
13
14
18
16
19
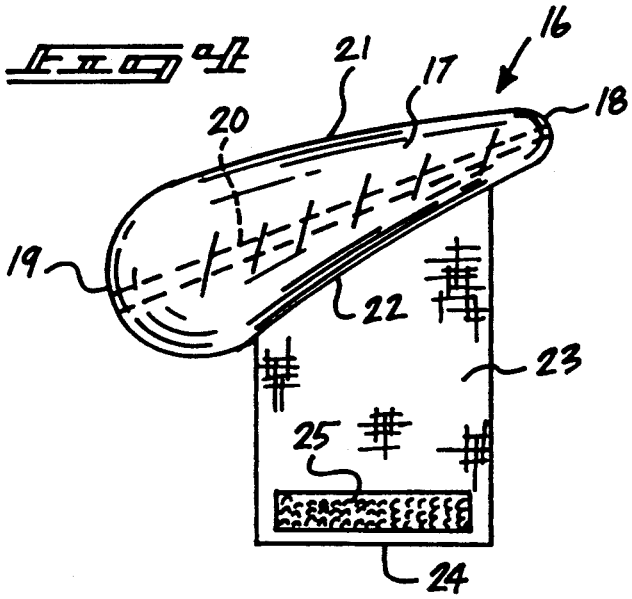
16
21
17
18
20
19
22
23
25
24

CLOTHES HANGER PAD CONSTRUCTION

BACKGROUND OF THE INVENTION

1. Field of the Invention

The field of invention relates to coat hanger construction, and more particularly pertains to a new and improved clothes hanger pad construction wherein the same includes pad members selectively securable to opposed ends of the coat hanger to minimize deformation of clothing suspended upon the hanger construction.

2. Description of the Prior Art

The use of coat hanger construction conventionally utilizes a wire-like member, wherein prolonged suspension of garments upon the wire-like member results in various deformations at shoulder portions of the clothing due to a stretching of fabric the clothing may utilize. The instant invention attempts to overcome deficiencies of the prior art by providing pad members that may be optionally retroactively mounted to construction to avoid deformation and enhance securement of clothing mounted upon an associated hanger member. Examples of prior art hanger construction may be found in U.S. Pat. No. 2,622,775 to Saski wherein a pre-formed hanger cover is surmounted over an existing hanger to provide an enlarged contact surface for a garment mounted thereon.

U.S. Pat. No. 2,828,899 to Zuckerman sets forth a covering for a garment hanger, wherein the covering includes a medial slot directed through an elongate covering member to receive a suspension hook of the coat hanger therethrough to permit the covering to overlie the coat hanger construction.

U.S. Pat. No. 4,658,997 to Nash sets forth a hanger covering member utilizing an enlarged surface area for support of garments positioned thereon.

U.S. Pat. No. 2,904,233 to Brothers sets forth tube-like members that may be surmounted about opposing ends of a coat hanger member to provide enhanced frictional engagement of the coat hanger member relative to a garment mounted on the hanger.

U.S. Pat. No. 2,147,590 to Adkins sets forth a shield defining a convex arcuate member surmounted about an upper surface of each of the downwardly extending legs of a coat hanger to provide enhanced surface area for use in association with a coat hanger.

As such, it may be appreciated that there continues to be a need for a new and improved clothes hanger pad construction wherein the same addresses both the problems of ease of use as well as effectiveness in construction and in this respect, the present invention substantially fulfills this need.

SUMMARY OF THE INVENTION

In view of the foregoing disadvantages inherent in the known types of clothes hanger constructions now present in the prior art, the present invention provides a clothes hanger pad construction wherein the same sets forth the use of supplemental pad members readily and securably surmounted about opposing ends of a coat hanger member. As such, the general purpose of the present invention, which will be described subsequently in greater detail, is to provide a new and improved clothes hanger pad construction which has all the advantages of the prior art clothes hanger constructions and none of the disadvantages.

To attain this, the present invention provides a pad construction for use and securement to each end of a coat hanger, wherein the pad construction includes an elongate flexible deformable pad positionable to accommodate clothing of various configurations, wherein the pad includes band construction to secure the pad to the clothes hanger member. The pad construction may be further formed with longitudinally parallel deformable rods to maintain a desired deformation of the pad relative to the coat hanger construction. Further, the pad is optionally formed with an elongate pocket directed through an upper surface of the pad to receive and secure a sponge-like absorbent member therewithin, wherein the sponge-like member is saturated with various fluids, such as perfume, anti-germicidal fluids, and insect control fluids such as moth repellants and the like.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved clothes hanger pad construction which has all the advantages of the prior art clothes hanger constructions and none of the disadvantages.

It is another object of the present invention to provide a new and improved clothes hanger pad construction which may be easily and efficiently manufactured and marketed.

It is a further object of the present invention to provide a new and improved clothes hanger pad construction which is of a durable and reliable construction.

An even further object of the present invention is to provide a new and improved clothes hanger pad construction which is susceptible of a low cost of manufacture with regard to both materials and labor, and which accordingly is then susceptible of low prices of sale to the consuming public, thereby making such clothes hanger pad constructions economically available to the buying public.

Still yet another object of the present invention is to provide a new and improved clothes hanger pad construction which provides in the apparatuses and methods of the prior art some of the advantages thereof, while simultaneously overcoming some of the disadvantages normally associated therewith.

Still another object of the present invention is to provide a new and improved clothes hanger pad construction wherein the same is readily retrofitted to an existing coat hanger member to provide an enlarged surface contact area deformable and re-contourable to accommodate various shapes and arrangements of clothing mounted about the clothes hanger member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an orthographic top view of the instant invention.

FIG. 10 is an orthographic view, taken along the lines 10—10 of FIG. 9, in the direction indicated by the arrows.

DESCRIPTION OF THE PREFERRED EMBODIMENT

Figure 1:
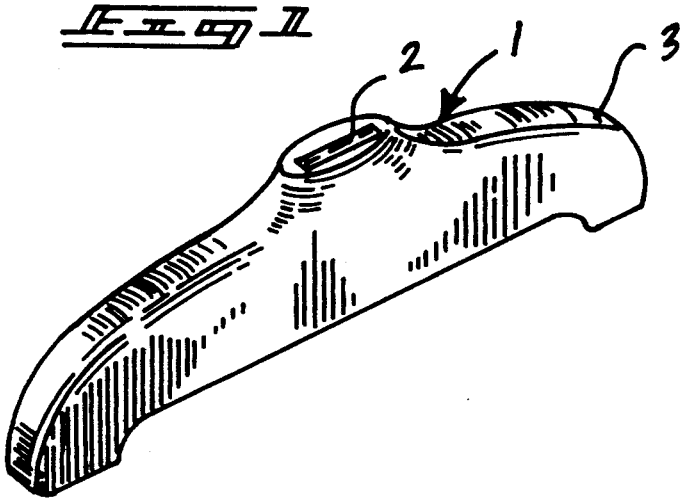
FIG. 1 is an isometric illustration of a prior art clothes hanger cover member.

With reference now to the drawings, and in particular to FIGS. 1 to 10 thereof, a new and improved clothes hanger pad construction embodying the principles and concepts of the present invention and generally designated by the reference numeral 10 will be described.

Figure 2:
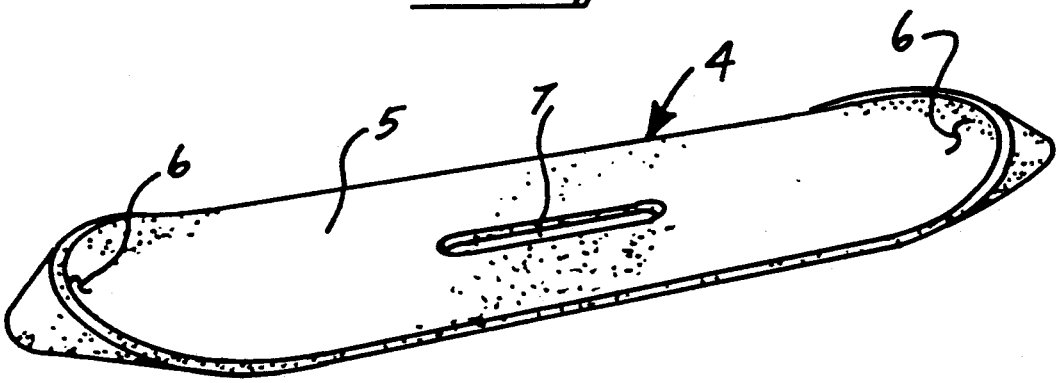
PRIOR ART Fig 2
FIG. 2 is an isometric illustration of a further example of prior art clothes cover member.
Figure 5:
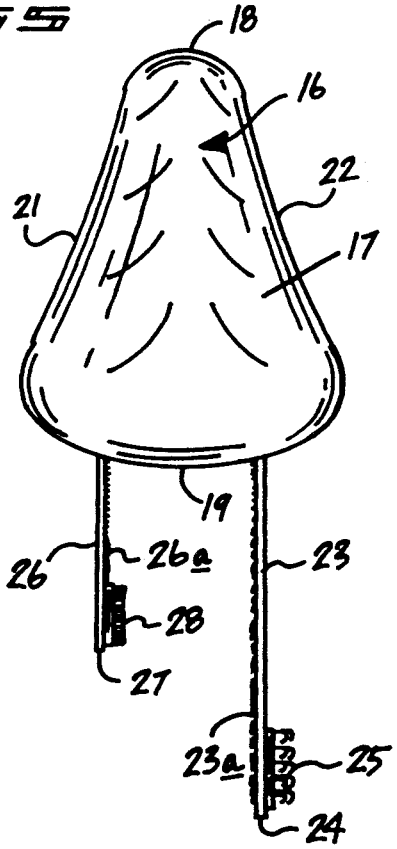
FIG. 5 is an orthographic rear view, taken in elevation, of the instant invention.

FIG. 1 illustrates a prior art coat hanger cover 1, wherein a slot 2 formed medially through the cover 3 receives a coat hanger member hook portion therethrough. FIG. 2 illustrates a further prior art coat hanger cover 4, wherein longitudinally opposed pockets 6 receive corner portions of an associated coat hanger, and wherein an elongate strip 5 includes a medial slot 7 to receive the hook portion of an associated coat hanger therethrough.

Figure 6:
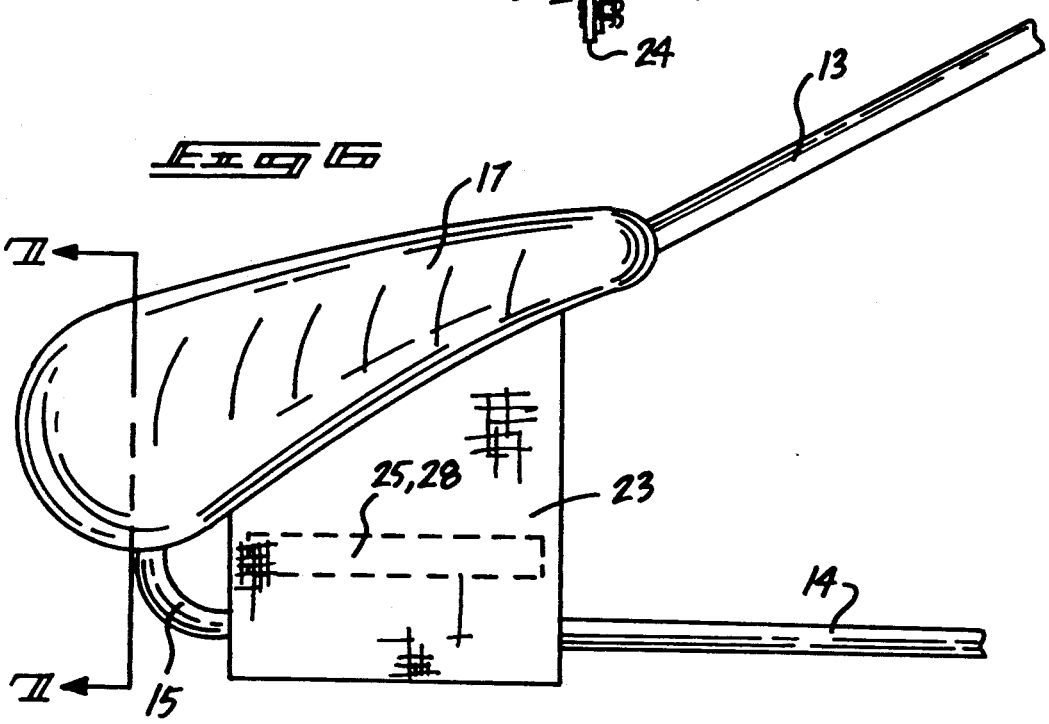
FIG. 6 is an orthographic view, taken in elevation, of a clothes hanger pad member utilized by the instant invention in association with an existing coat hanger member.

More specifically, the clothes hanger pad construction 10 of the instant invention essentially comprises a combination with an association coat hanger member that includes a first leg 11 and a second leg 13 joined together at an apex to a hanger shank 12, including a hook portion. The first and second legs 11 and 13 respectively are joined at laterally spaced leg corners 15 to a cross leg 14. The support pads 16 of the instant invention each include a cover pad 17 formed of a relatively soft polymeric or fabric member, including an arcuate forward end 18 defined by a first radius of curvature and an arcuate lower end 19 defined by a second radius of curvature greater than the first radius of curvature, including right and left respective lateral edges 21 and 22. A channel 20 is directed medially and longitudinally coextensive through a bottom surface of the cover pad 17. The channel 20 enhances positioning of the cover pad 17 relative to an associated first and second leg 11 and 13 of the coat hanger member. A first support band 23 is formed of a flexible material and is mounted to the left lateral edge 22 at an acute angle included therebetween and is defined by a first length. A second flexible support band 26 defined by a second length less than that of the first length less is mounted to the right lateral edge 21, wherein the respective first and second flexible bands each include respective lower terminal ends 24 and 27, each mounting a respective first and second hook and loop fastener strips adjacent to and parallel the respective lower terminal ends of the first and second bands, in a manner as set forth in FIG. 5. The first and second hook and loop fastener strips permit securement in an enveloping relationship relative to the coat hanger member, in a manner as illustrated in FIG. 6. Further, it should be noted that each of the bands 23 and 26 include an elastomeric interior surface 23*a* and 26*a* respectively to enhance frictional engagement with the associated coat hanger legs when surmounted thereabout.

Figure 7:
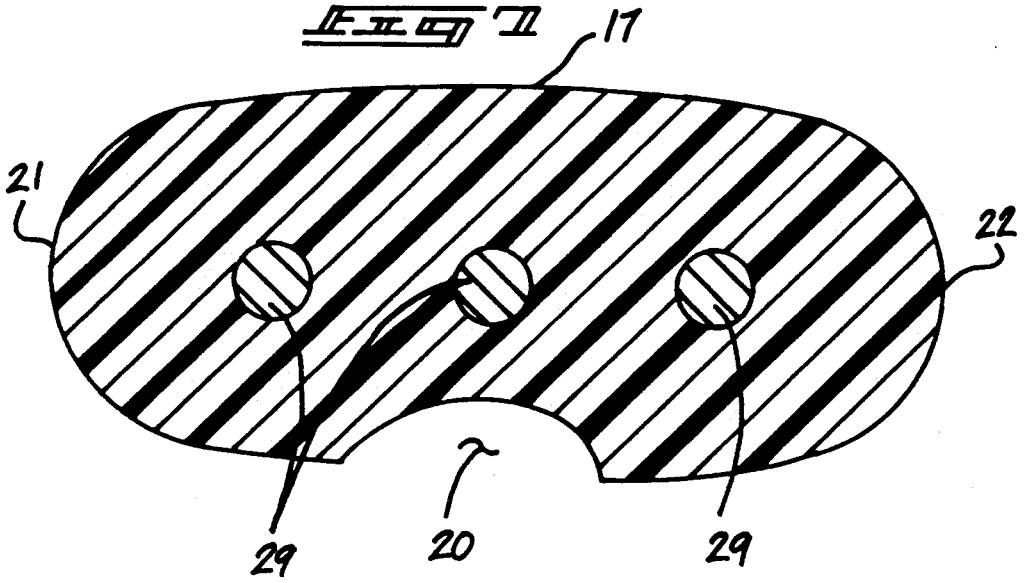
FIG. 7 is an orthographic view, taken along the lines 7—7 of FIG. 6, in the direction indicated by the arrows.

Reference to FIG. 7 illustrates the cover pad 17 formed with parallel deformable reinforcing rods 29 that are coextensively formed throughout the pad 17 to permit selective deformation of the pad 17 to permit its retention of a deformed configuration to accommodate various configurations of garments to be mounted thereon, thereby permitting the pad 17 to be reshaped to provide a complementary configuration to an associated garment of clothing to be positioned thereon.

Figure 8:
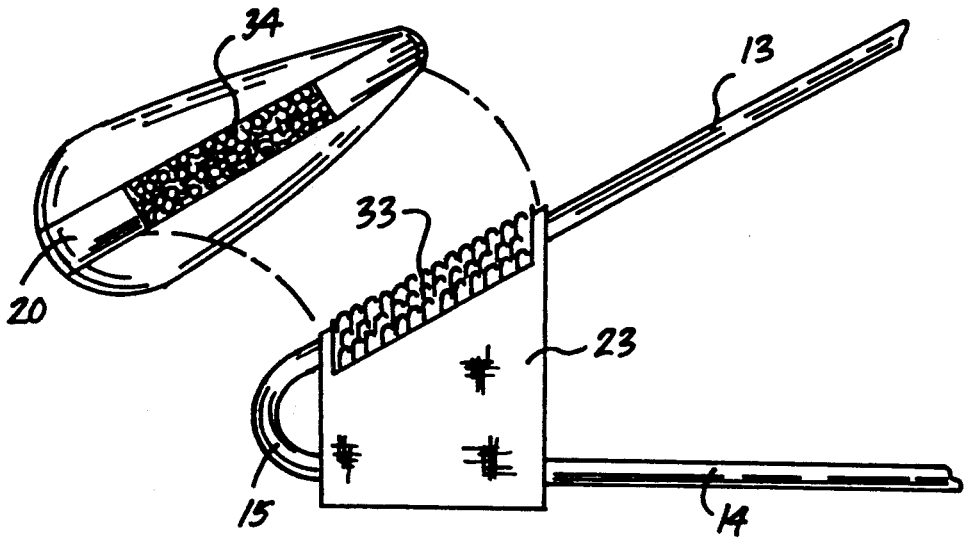
FIG. 8 is an isometric illustration of the coat hanger pad member utilizing a hook and loop fastener surface mounted within the channel member utilized by the pad member to mount the pad member to an existing coat hanger member.

FIG. 8 illustrates the use of a third hook and loop fastener strip 33 mounted to upper terminal ends of the first and second bands, wherein the third hook and loop fastener strip 23 is cooperative with a fourth hook and loop fastener strip 34 mounted within the channel 20 to permit selective securement of the pad thereon, whereby removal thereof permits ease of maintenance and cleaning of the associated pad structure.

Figure 9:
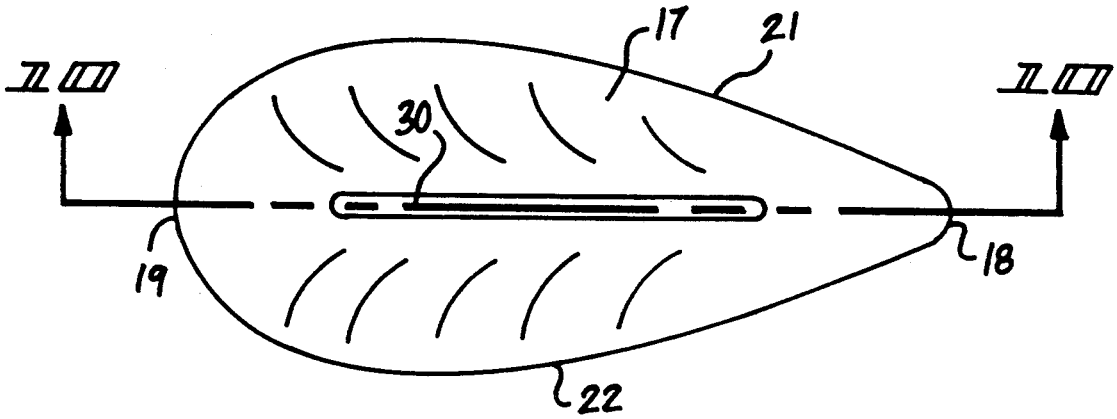
FIG. 9 is an orthographic top view of the coat hanger pad member utilizing an elongate pocket mounted within an upper surface of the pad member.
Figure 11:
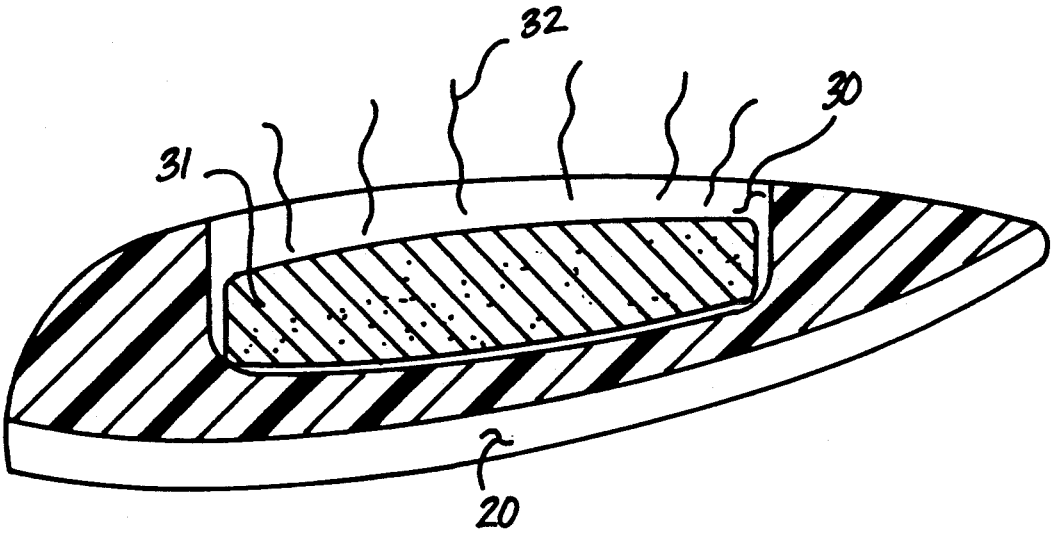

FIG. 9 illustrates the use of the pad 17 formed with an elongate pocket cavity 30 that is recessed below a top surface of the pad 17, and mounts therewithin an absorbent sponge-like member 31. The sponge-like member 31 is saturated with a selective fluid such as a mold and mildew retarding chemical, an insect repellent such as for moths and the like, or a perfumed fluid to enhance a predetermined aroma into an associated garment of clothing. It is noted that the pocket cavity 30 overlies the associated channel 20 to align the pocket relative to the pad to thereby orient the pocket coextensively with an associated leg of the coat hanger member to thereby prevent spillage of excess fluid contained within the pocket 30 and thereby direct the vapor 32 from an associated fluid in the sponge-like member 31 upwardly into an associated clothing garment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as being new and desired to be protected by Letters Patent of the United States is as follows:

1. A clothes hanger and pad construction for securement to a clothes hanger member, wherein the clothes hanger member includes a first leg fixedly mounted to a second leg, and wherein the first and second legs each define a respective spaced leg corner, with a cross leg mounted to each lower terminal end of each first and second leg, and each clothes hanger pad arranged for securement about each corner, and each clothes hanger pad comprising an elongate longitudinally aligned cover pad, the cover pad including a top surface and a bottom surface, and a forward end, and a lower end, wherein the lower end is positioned adjacent a respective corner of the hanger member, and the bottom surface of the cover pad including a longitudinally aligned channel directed medially and bisecting the forward end and lower end, and the pad including a right side and a left side, and a first support band mounted to the right side and a second support band mounted to the left side, wherein the first and second bands are flexible and arranged for securement relative to one another for securement to the hanger member, and wherein the forward end is defined by a first radius of curvature and the lower end is defined by a second radius of curvature, wherein the second radius of curvature is greater than that defined by the first radius of curvature to define a generally pie-shaped cover pad, and wherein the first support band is mounted at an acute included angle to the right edge and the second flexible band is mounted at an acute angle to the second edge, and the first band including a first band lower end and the second band including a second lower end, wherein each lower end is oriented at the acute angle relative to the respective right and left edges of the cover pad, and a first hook and loop fastener strip mounted adjacent the first band lower end, and a second hook and loop fastener strip mounted adjacent the second band lower end, wherein the first and second hook and loop fastener strips are arranged for securement relative to one another to envelope the hanger member for securement thereto, and wherein the cover pad includes a plurality of deformable parallel rods imbedded within and directed coextensively and longitudinally of the cover pad to permit deformation of the cover pad to accommodate various contours of clothing positioned thereon.

2. An apparatus as set forth in claim 1 wherein the top surface of the cover pad includes an elongate enclosed pocket cavity recessed below the top surface, and the pocket cavity including a sponge-like fluid absorbent member positioned within the pocket to permit absorption of an aromatic fluid within the sponge-like member.

3. An apparatus as set forth in claim 2 further including a third hook and loop fastener strip mounted at upper terminal ends of the first and second flexible band, and including a fourth hook and loop fastener strip mounted within the channel of the cover pad to permit selective removal and securement of the cover pad relative to the first and second flexible bands.

4. An apparatus as set forth in claim 3 wherein the first flexible band includes a first elastomeric frictional surface formed about an interior surface of the first band, and wherein the second band includes a second elastomeric frictional surface formed throughout an interior surface of the second band to enhance frictional engagement of the first and second bands about the hanger member.

* * * * *